United States Patent [19]

Dulin et al.

[11] 4,088,423

[45] May 9, 1978

[54] HEAVY DUTY RADIATOR COOLING FAN

[75] Inventors: Patrick J. Dulin, Jackson; Thomas G. Gorman, Hanover; Neil E. Robb, Jackson; Robert G. Wickham, Clacklake, all of Mich.

[73] Assignee: Hayes-Albion Corporation, Jackson, Mich.

[21] Appl. No.: 736,477

[22] Filed: Oct. 28, 1976

[51] Int. Cl.[2] ..... F04D 29/34

[52] U.S. Cl. ..... 416/210 R; 416/DIG. 3; 416/132 A; 416/214 R

[58] Field of Search ..... 416/DIG. 3, 214, 210, 416/132 A, 60, 169 A

[56] References Cited

U.S. PATENT DOCUMENTS

| | | | |
|---|---|---|---|
| D. 232,362 | 8/1974 | Bonifant | 416/DIG. 3 |
| 1,313,598 | 8/1919 | Ingells | 416/DIG. 3 |
| 2,201,153 | 5/1940 | Brown | 416/DIG. 3 |
| 2,351,225 | 6/1944 | Patrick et al. | 416/210 |
| 2,661,148 | 12/1953 | Englander | 416/DIG. 3 |
| 2,794,509 | 6/1957 | Mix | 416/DIG. 3 |
| 3,323,596 | 6/1967 | Mobius | 416/169 A X |
| 3,733,147 | 5/1973 | Felker | 416/214 |
| 3,785,748 | 1/1974 | Gorman | 416/210 X |
| 4,025,231 | 5/1977 | Kochevar et al. | 416/236 R X |
| 4,050,847 | 9/1977 | New et al. | 416/210 R |
| 4,053,260 | 10/1977 | Yee | 416/DIG. 3 |

FOREIGN PATENT DOCUMENTS

| | | | |
|---|---|---|---|
| 1,267,976 | 6/1961 | France | 416/DIG. 3 |
| 1,428,276 | 1/1969 | Germany | 416/214 |
| 490,648 | 8/1938 | United Kingdom | 416/214 |
| 833,938 | 5/1960 | United Kingdom | 416/214 |

*Primary Examiner*—Everette A. Powell, Jr.

[57] ABSTRACT

A radiator cooling fan assembly is disclosed for use in trucks and other large vehicles. The heavy duty assembly includes a pair of hubs having radially extending arms with blades extending between aligned pairs of hub arms. The arms of one hub are substantially shorter than the arms of the other hub. In addition, the either hub may include either an enlarged aperture in its central portion or webbing between its arms or both.

1 Claim, 2 Drawing Figures

HEAVY DUTY RADIATOR COOLING FAN

BACKGROUND OF THE INVENTION

The present invention relates generally to radiator cooling fans. More specifically, the invention is directed to a heavy duty radiator cooling fan assembly which may be economically manufactured and facilely assembled while maintaining the stringent performance and endurance standards required in the demanding environment of trucks, off-the-road equipment and other large vehicles.

A variety of fan structures have been developed for use in the cooling systems of automobiles, trucks and other vehicles. These fan structures, or assemblies, must be capable of withstanding extreme environmental conditions while still providing suitable air flow over the radiator and vehicle engine. It is important, therefore, that radiator cooling fans, and particularly those used in trucks and other large vehicles, be ruggedly constructed so as to provide long service life substantially free from maintenance.

In addition, it is important that these fan assemblies weigh as little as possible, since increased weight may adversely affect the operation or useful life of other associated engine components, such as the water pump, clutches and fan pulleys. Accordingly, the construction of prior art cooling fans has required a compromise between strength and durability on the one hand and the overall weight of the fan assembly on the other.

Prior art radiator cooling fans used for trucks and larger vehicles typically comprise an assembly of two hubs between which are mounted a plurality of fan blades. In the past these hubs, which are shaped as spiders, have each had radially extending arms of equal length. In addition, the hubs have been either formed to adjoin one another in their central mounting portion or have been separated by an insert plate. These structural arrangements have resulted in increased weight, difficulty in assembly and installation and generally increased costs of manufacture.

SUMMARY OF THE INVENTION

Accordingly, the present invention is directed to an improved, heavy duty radiator cooling fan having improved strength and weight characteristics and which incorporates certain structural innovations to facilitate assembly and installation and to reduce the costs of manufacture.

Generally, the fan assembly of the present invention includes a pair of hubs or spiders, having a plurality of fan blades each extending from between an aligned pair of the hub arms. One of the hubs arms which are substantially shorter than the arms of the other hub. The short-armed hub, also has an enlarged central aperture and webbing between each arm which extends radially beyond the central portion of the long-armed hub. The enlarged central aperture allows easy access to the pilot and mounting apertures located in the central portion of the long-armed hub, and the webbing configuration enhances strength and durability and may, in certain circumstances, also increase air flow produced by the fan as well as dampen vibration.

BRIEF DESCRIPTION OF THE DRAWINGS

The novel features which are believed to be characteristic of the present invention are set forth in the appended claims. The invention itself, however, together with further objects and attendant advantages thereof, will be best understood by reference to the following description taken in connection with the accompanying drawings, in which:

DETAILED DESCRIPTION OF THE PREFERRED EMBODIMENT

Figure 1:
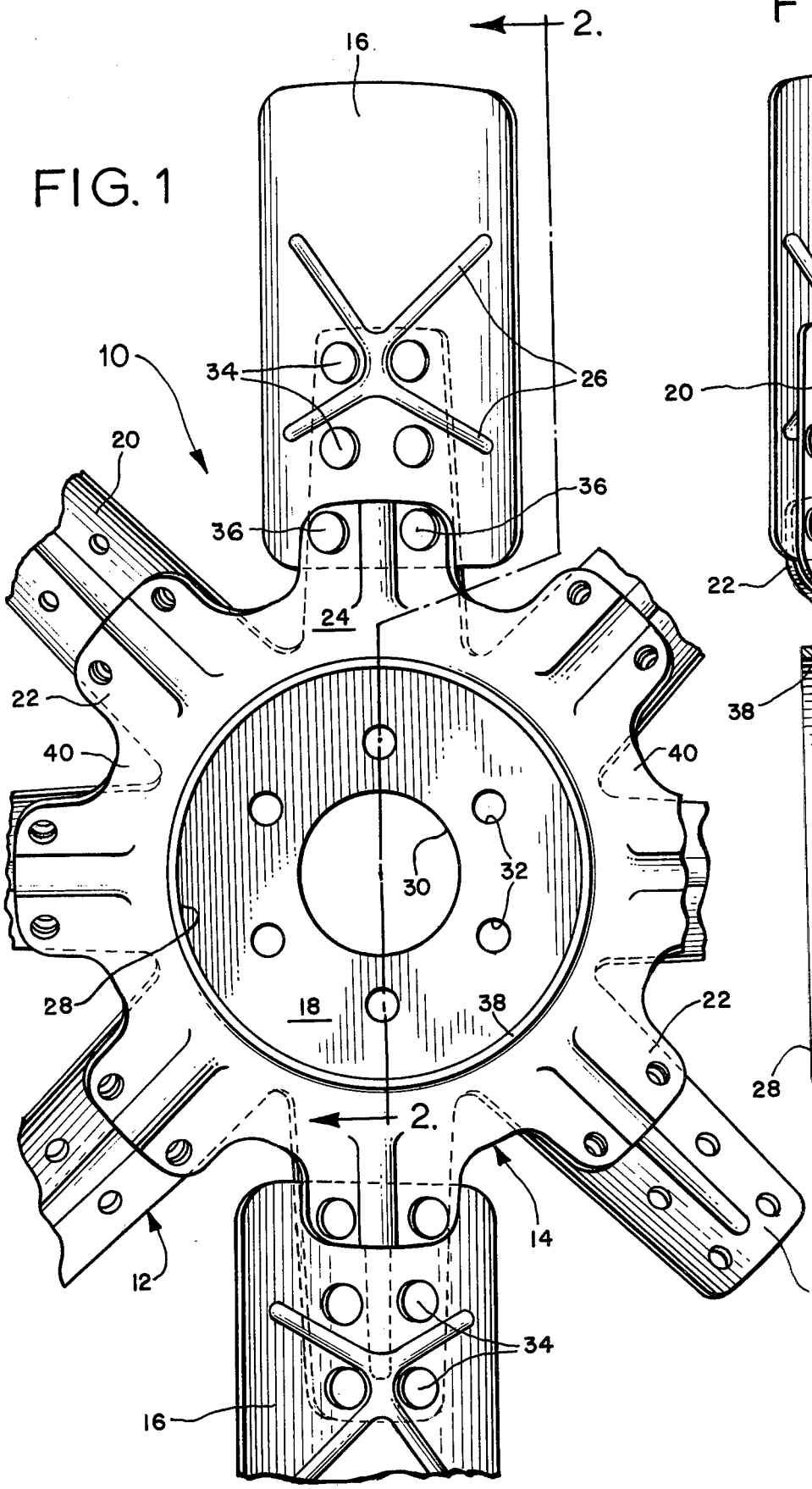
FIG. 1 is a plan view of a preferred fan assembly constructed in accord with the present invention.

One preferred embodiment of the present invention is the fan assembly illustrated in the drawings and designated generally as 10. The fan assembly 10 includes a first hub 12, a second hub 14, a plurality of fan blades 16 and means for securing these components in assembled relation.

The hub 12 includes a central portion 18 and a plurality of integrally formed, radially extending arms 20. The second hub 14 includes a like plurality of integrally formed arms 22 radially extending from a central portion 24. In accordance with the present invention the arms 22 of hub 14 are of substantially shorter length than arms 20 of hub 12. This arrangement not only reduces the weight of the fan but also facilitates its assembly since it is not necessary to align all of the rivet holes in each hub arm and each blade. Moreover, the blades 16 may include raised ribs, such as reinforcing rib 26, without interfering with the proper mounting of the blades 16 to the hub 14.

The arms 20 of the hub 12 provide primary support to each of the blades 16. To achieve this purpose it is desirable that the arms 20 extend outwardly to a point approximately midway along the length of the blades 16. The arms 22 of hub 14 provide only secondary support to the individual blades, but the entire hub 14 provides structural rigidity to the entire fan assembly 10.

Thus, the arms 22 extend outwardly only so far as is necessary to properly secure the hub 14 to each blade 16 and arm 20. Therefore, as can be seen clearly in FIG. 1, the rivets 34, or other fastening means, secure the blades 16 to only the long arms 20, whereas the rivets 36 secure the blades 16 to both the long arms 20 and the short arms 22.

The hub 14 also includes an enlarged central aperture 28 whose diameter is sufficient to provide easy access to the central pilot aperture 30 and the mounting apertures 32 located in the central portion 18 of the hub 12. It will be appreciated by those skilled in the art that such an arrangement obviates the difficulty of properly aligning mounting holes in both hubs. At the same time the fan assembly 10 enjoys a reduction in weight by eliminating much of the central portion 24.

Figure 2:
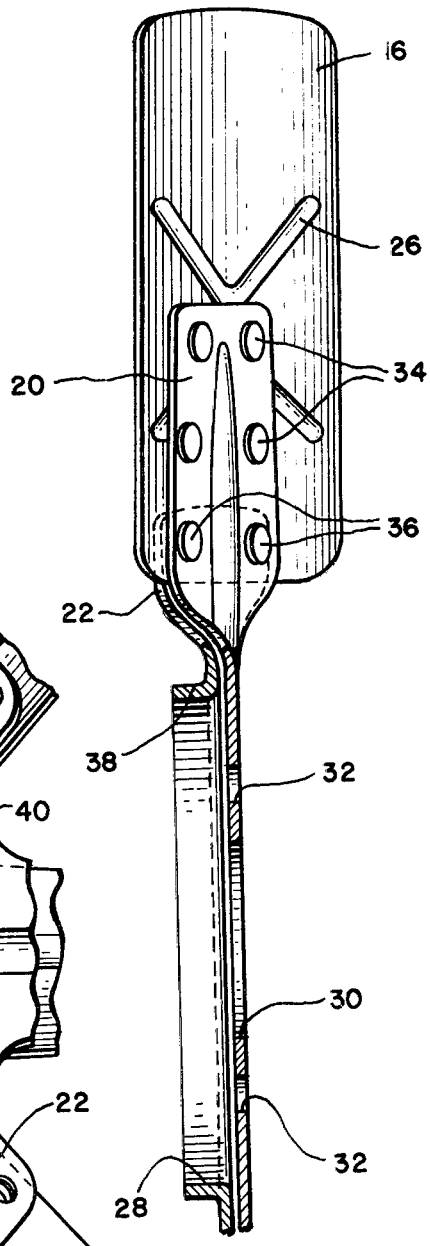
FIG. 2 is a side elevational view, in partial cross-section, taken along line 2—2 of FIG. 1.

As is clearly illustrated in FIG. 2, the hub 14 also includes in this embodiment an extruded flange 38 which defines the circumference of aperture 28. The flange 38 also enhances the structural integrity of the fan assembly 10 without any significant weight increase.

The durability of the assembly 10 is also enhanced by utilization of the webbing 40 between the arms 22 of hub 14. The webbing 40 defines the outer edge of central portion 24 which terminates radially outwardly of central portion 18 of hub 12. The webbing 40 improves durability without an increase in manufacturing costs since it is formed from material which is generally scrap in typical prior art manufacturing processes.

It will be appreciated by those skilled in the art that the preferred fan assembly 10, illustrated herein, is mounted to the vehicle engine only through hub 12, and specifically by means of bolts (not shown) engaging mounting apertures 32. This arrangement eliminates the requirement in prior art structures wherein the two hubs adjoin one another or are supportedly engaged, as by means of a spacer insert plate. Thus, as is clearly illustrated in FIG. 2, the hubs 12 and 14 may be maintained in spaced relationship without any attendant weakening of the fan assembly 10.

From the foregoing, it will be apparent that the fan assembly of the present invention may be more economically manufactured and more easily assembled and installed. In addition, the structural arrangement characteristic of the invention provides for improved strength and durability. Of course, various changes and modifications to the preferred embodiment described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. A heavy duty fan assembly, comprising:

a first hub including a central pilot aperture and mounting apertures and a plurality of integrally formed, radially extending spider arms;

a second hub including an enlarged central aperture and a plurality of integrally formed, radially extending spider arms having a length substantially shorter than that of said spider arms on said first hub;

a plurality of rigid fan blades each extending outwardly from between an aligned pair of said first and second hub arms;

said first and second hubs being maintained in spaced relation;

and said spider arms on said first and second hubs overlying each other.

* * * * *